US011772690B2

(12) United States Patent
Deuter et al.

(10) Patent No.: US 11,772,690 B2
(45) Date of Patent: Oct. 3, 2023

(54) APPARATUS AND METHOD FOR CONFIGURING SYSTEMS IN RAIL VEHICLES

(71) Applicant: KNORR-BREMSE SYSTEME FÜR SCHIENENFAHRZEUGE GMBH, Munich (DE)

(72) Inventors: Martin Deuter, Höhenkirchen-Siegertsbrunn (DE); Martin Gwildies, Munich (DE)

(73) Assignee: KNORR-BREMSE SYSTEME FÜR SCHIENENFAHRZEUGE GMBH

( * ) Notice: Subject to any disclaimer, the term of this patent is extended or adjusted under 35 U.S.C. 154(b) by 437 days.

(21) Appl. No.: 16/488,886

(22) PCT Filed: Feb. 20, 2018

(86) PCT No.: PCT/EP2018/054111

§ 371 (c)(1),
(2) Date: Aug. 26, 2019

(87) PCT Pub. No.: WO2018/158108

PCT Pub. Date: Sep. 7, 2018

(65) Prior Publication Data

US 2021/0129877 A1 May 6, 2021

(30) Foreign Application Priority Data

Mar. 1, 2017 (DE) ..... 10 2017 104 204.0

(51) Int. Cl.

| | |
|---|---|
| ***B61L 3/00*** | (2006.01) |
| ***B61L 15/00*** | (2006.01) |
| *B61C 17/12* | (2006.01) |

(52) U.S. Cl.
CPC ..... *B61L 3/006* (2013.01); *B61L 3/008* (2013.01); *B61L 15/0018* (2013.01);
(Continued)

(58) Field of Classification Search
CPC ..... B61L 15/0018; B61L 15/0072; B61L 15/0081; B61L 3/006; B61L 3/008; B61C 17/12; B60L 3/12; B60L 2200/26
(Continued)

(56) References Cited

U.S. PATENT DOCUMENTS

| | | | |
|---|---|---|---|
| 6,691,957 | B2 | 2/2004 | Hess, Jr. et al. |
| 7,395,141 | B1 | 7/2008 | Seck et al. |

(Continued)

FOREIGN PATENT DOCUMENTS

| | | | |
|---|---|---|---|
| DE | 102012202931 | A1 | 9/2012 |
| WO | 2009035751 | A1 | 3/2009 |
| WO | 2016141366 | A1 | 9/2016 |

OTHER PUBLICATIONS

European Office Action corresponding to 17 170 030.5, dated Feb. 22, 2019.

*Primary Examiner* — Zachary L Kuhfuss
(74) *Attorney, Agent, or Firm* — BARNES & THORNBURG, LLP

(57) ABSTRACT

The invention relates to an apparatus for configuring systems, the apparatus being positioned as intended in a rail vehicle and comprising—a data-processing unit—information-transmitting connections between the data-processing unit and the systems—a selection unit for selecting a saved profile—an input unit for inputting operating parameters—a receiving unit for receiving additional or altered profiles.

10 Claims, 1 Drawing Sheet

(52) U.S. Cl.
CPC ..... *B61L 15/0072* (2013.01); *B61L 15/0081* (2013.01); *B61C 17/12* (2013.01); *B61L 2201/00* (2013.01)

(58) Field of Classification Search
USPC ..... 701/19
See application file for complete search history.

(56) References Cited

U.S. PATENT DOCUMENTS

| | | | | |
|---|---|---|---|---|
| 8,398,405 | B2 * | 3/2013 | Kumar | B61C 17/12 434/66 |
| 9,862,397 | B2 | 1/2018 | Meyer et al. | |
| 2005/0251299 | A1 * | 11/2005 | Donnelly | B60L 15/20 701/19 |
| 2010/0019718 | A1 * | 1/2010 | Salasoo | B60L 58/18 320/103 |
| 2011/0257869 | A1 * | 10/2011 | Kumar | B61L 25/025 701/103 |
| 2012/0277940 | A1 * | 11/2012 | Kumar | B61L 27/0027 701/20 |
| 2012/0303187 | A1 * | 11/2012 | Sexauer | B61L 25/028 701/19 |
| 2013/0018531 | A1 * | 1/2013 | Kumar | B61L 25/025 701/2 |
| 2014/0222971 | A1 * | 8/2014 | Cooper | H04L 67/1097 709/219 |
| 2014/0316618 | A1 * | 10/2014 | Matthews, Jr. | B60L 15/2018 701/19 |
| 2016/0010574 | A1 | 1/2016 | Kumar et al. | |
| 2018/0037241 | A1 * | 2/2018 | Sharma | B61L 3/008 |
| 2018/0118238 | A1 * | 5/2018 | de Albuquerque Gleizer | B61L 3/02 |

* cited by examiner

APPARATUS AND METHOD FOR CONFIGURING SYSTEMS IN RAIL VEHICLES

CROSS REFERENCE AND PRIORITY CLAIM

This patent application is a U.S. National Phase of International Patent Application No. PCT/EP2018/054111 filed Feb. 20, 2018, which claims priority to German Patent Application No. 10 2017 104 204.0, the disclosure of which being incorporated herein by reference in their entireties.

FIELD

Disclosed embodiments relate to an apparatus and a method for configuring hierarchical systems in a rail vehicle, a computer-implemented method for configuring systems in a rail vehicle, and a computer program product for carrying out the computer-implemented method.

BACKGROUND

Rail vehicles contain a variety of interacting systems. Sophisticated coordination of systems may be referred to as a configuration, which may contain a variety of operating parameters and formal rules for the coordinated and smooth operation of the rail vehicle.

The now-commonplace interaction of the various systems in a rail vehicle is controlled by one or several data processing units which communicate with one another. Depending on the level of complexity of the rail vehicle, a data processing unit either directly controls the systems situated in the vehicle, or the data processing unit exerts an influence on other data processing units which are integrated into the systems. The operating parameters which are saved in the data processing device(s) have significant influence on the system behavior.

Operating parameters may be understood to be adjustable technical variables which affect the operation of the systems. The parameters may, for example, be temperatures, speeds, electrical power, etc., wherein ranges may also be defined which have allowable extreme values. Here, the list of the aforementioned operating parameters constitutes merely an exemplary selection.

One example of communication between such systems is the dependence of the door control on the driving speed. For reasons of safety, the doors can be opened only if the rail vehicle is stationary. Likewise, the rail vehicle can start moving only if all doors are closed and are securely locked (electronically).

Another example of a dependence on systems is, for example, the traveling speed-controlled regulation of the air conditioning system. At high speeds, the air extraction performance of air conditioning systems in rail vehicles is increased in order to be able to convey the exhaust of the air conditioning systems out of the rail vehicle, despite the rapidly flowing air stream which is present on the vehicle contour.

A large proportion of the development time of a rail vehicle consists of coordinating systems which have already been partially integrated into other projects. The combination and the desired interaction of the systems requires a well-designed configuration which may be highly complex, depending on the number of systems to be integrated.

Even after the completion of the development of a rail vehicle, there are generally specific adjustments to operator specifications or customer requests. This has to do with the fact that the routes which are be traveled at later time must be considered, as well as the existing infrastructure, for example, the power supply and signaling.

If a customer receives a number of rail vehicles which have been specifically adapted to the requirements of the customer, this is referred to as a "fleet" of vehicles. The customizations which are generally carried out across a fleet take place by setting a particularly adjusted configuration of the data processing units, wherein the configuration in turn receives a variety of operating parameters and rules which have been coordinated with one another.

In some cases, a change in the configuration is requested by the operator to the effect that individual operating parameters are to be adjusted.

Due to the interactions of the individual systems, such changes may currently be implemented only in a very precisely prescribed change process for safety reasons.

However, this approach has a number of disadvantages. For example, changes to a configuration which relate to a fleet or a plurality of fleet vehicles may be carried out simultaneously on all fleet vehicles. On the other hand, due to the criticality of the modified operating parameters, the change may be carried out only by qualified personnel. Due to the complexity of the changes which potentially relate to systems which appear to be independent of one another, even if great care is taken, there is the possibility of erroneous entries, which in the worst case may result in an accident.

SUMMARY

Disclosed embodiments simplify changes to the configuration of a vehicle fleet or individual fleet vehicles and to reduce the probability of errors during the vehicle configuration.

In accordance with disclosed embodiments, operating parameters and rules may be combined into a profile, which may include a collection of coordinated operating parameters, and optionally, formal rules for controlling systems, subsystems, and components.

As a result, in the event that it is necessary to change operating parameters, it is possible to exchange one profile for another profile, or to deactivate a currently active profile and to activate another profile.

In accordance with disclosed embodiments, in addition to a data processing unit, an apparatus for configuration of the systems in a rail vehicle may have a selection unit for selecting a saved profile, an input unit for inputting operating parameters, and a reception unit for receiving additional or modified profiles.

BRIEF DESCRIPTION OF THE FIGURES

Disclosed embodiments are illustrated in the figures, in which.

DETAILED DESCRIPTION

Figure 1:
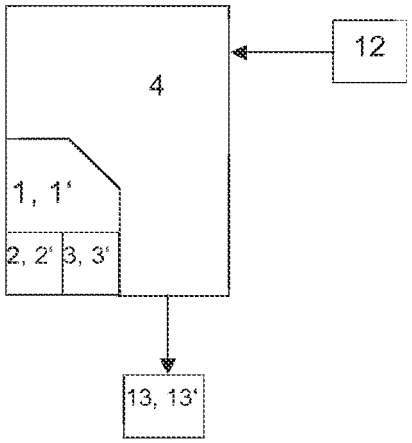
FIG. 1 depicts an example of the data processing unit containing the information about a profile.

Disclosed embodiments simplify changes to the configuration of a vehicle fleet or individual fleet vehicles and to reduce the probability of errors during the vehicle configuration.

In accordance with disclosed embodiments, operating parameters and rules may be combined into a profile, which may include a collection of coordinated operating parameters, and optionally, formal rules for controlling systems, subsystems, and components.

As a result, in accordance with disclosed embodiments, configuration of the data processing unit of a rail vehicle may take place rapidly and without error. Such a configuration may take place before transferring the rail vehicle to the operating or customer, and may take specific operator/customer requirements into consideration. Requirements of the operator or customer may thus be individual requests with respect to the interaction of the vehicle systems, as well as adjustments to geographically contingent specifications (for example, route routing, curve radii) or county-specific regulations (for example, speed limits).

The reception of a profile takes place via a reception unit. The reception unit may be designed in such a way that it receives profiles from an employee on site. The conventional near-field transmission paths (for example, Bluetooth®, WLAN, etc.) are suitable for this purpose.

However, profiles may also be transmitted from a central point directly to the reception units. Such a configuration by means of the reception of a profile may advantageously take place not only individually per vehicle, but also across all vehicles in a fleet or in relation to a portion of a fleet. Thus, it is ensured that all vehicles affected by the configuration modification are operated using the same operating parameters.

A configuration modification by means of the deactivation of the profile and the activation of another profile may then advantageously take place if the operating conditions (for example, weather, time of day or season, speed, position, etc.) change, and another profile is requested for the operation. Thus, it is possible, for example, to carry out season-related configuration changes by selecting the profile which is appropriate for the season. Another exemplary reason for activating a profile may, for example, be housing the rail vehicle in the depot overnight. A specific resting profile may, for example, ensure minimal noise emissions, while selected functions (for example, opening the door) are maintained. Particularly in this resting profile, rule-based operating states may also be defined which are to be strictly avoided during normal operation, for example, "traveling while the door is open."

The selection of the appropriate profile may take place manually at the selection unit by means of appropriately trained personnel. Alternatively, the activation of the profile may also take place from the central point.

In an additional embodiment, the selection of a profile may also take place automatically or semi-automatically. For performing automatic modification, operating conditions, for example, the date, meteorological data, adhesion conditions, or environmental conditions (for example, particulate matter pollution) may be used.

In the case of a semi-automatic configuration modification, it may be provided that the data processing unit suggests a profile, and the suggestion must be accepted via the selection unit by appropriately trained personnel.

In another embodiment, changes to the operating parameters or to the profile may be carried out only in a particular vehicle mode. The mode may, for example, be a special service mode. It is thus ensured that operating parameters cannot be changed during travel.

In another embodiment, changes to the operating parameters of a data processing unit may result in operating parameters also changing for other data processing units. It is thereby ensured that complex relationships between individual operating parameters do not necessarily have to be considered, but rather, a configuration which is safe for operation is always achieved.

In another embodiment, changes to the profile or to the operating parameters are carried out. However, the profile becomes active only if operating conditions are achieved which are to be determined beforehand. In this case, possible operating conditions may, for example, include exceeding the exterior temperature or exceeding a date limit.

In another embodiment, profiles or operating parameters may be modified within determined limits via the input unit. Thus, a vehicle-specific profile is possible which still ensures safe operation.

In another embodiment of the disclosed apparatus, a transmitting unit is installed. Under certain circumstances, it may be necessary to transmit profiles or individual operating parameters of a profile back to a central point. This facilitates documentation, and may also facilitate a possible analysis of technical problems with a rail vehicle.

FIG. 1 depicts the data processing unit 4 containing the information about a profile 1. On the one hand, the profile 1 contains operating parameters 2, and on the other hand, it contains rules 3 for operating the systems. On the basis of existing or measured operating conditions 12, the data processing unit 4 controls the various systems via the control information 13 as a function of the operating parameters 2 and the rules 3. If a profile 1' is selected which differs from profile 1, the control information 13' differs from the control information 13 under the same operating conditions 12 according to the operating parameters 2' and rules 3'.

Figure 2:
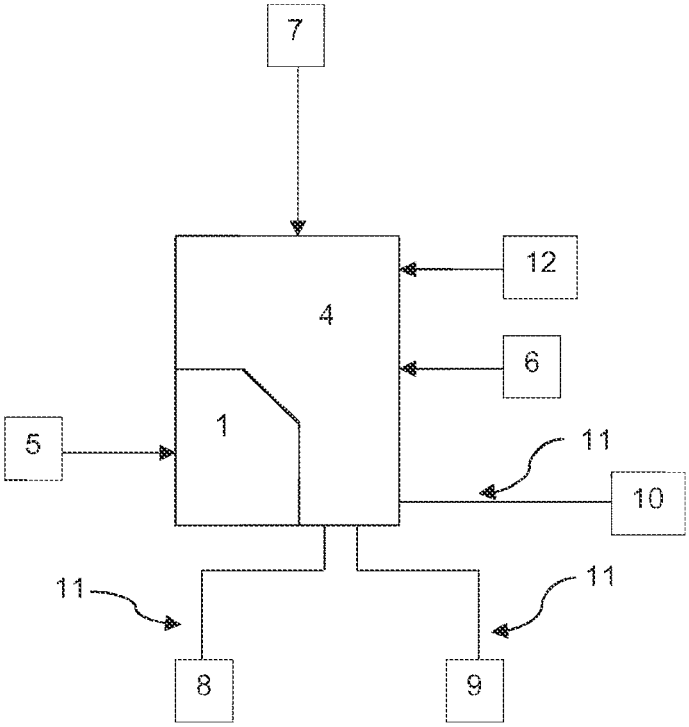
FIG. 2 shows an example of the data processing unit having the profile according to the disclosed embodiments.

FIG. 2 shows the data processing unit 4 having the profile 1. Via the input unit 5, the operating parameters of the profile may be adjusted as needed. The selection unit 6 enables the selection of a different profile. Via the reception unit 7, other profiles or modified profiles may be received. Information-transmitting connections 11 to the systems 8, 9, and 10 are connected to the data processing unit 4. The control information for the systems 11 is ascertained by the data processing unit 4 as a function of the operating parameters 12 and the selected profile 1. The number of systems connected to the data processing unit is determined by way of example.

LIST OF REFERENCE CHARACTERS

1, 1' Profile
2, 2' Operating parameter
3, 3' Rule
4 Data processing unit
5 Input unit
6 Selection unit
7 Reception unit
8 System A
9 System B
10 System C
11 Information-transmitting connection
12 Operating conditions
13 Control information for systems

The invention claimed is:

1. An apparatus for configuring rail vehicle systems, wherein the apparatus is arranged in a rail vehicle, the apparatus comprising a data processing unit;

information-transmitting connections from the data processing unit to the rail vehicle systems;

a selection unit for selecting a saved profile containing operating parameters and rules for controlling the rail vehicle systems, wherein in response to a detected operation of one of the operating parameters in one of the rail systems, another of the operating parameters is operated according to the selected saved profile;

an input unit for inputting operating parameters; and a reception unit for receiving additional or modified profiles, wherein the apparatus is adjusted such that additional and modified profiles are received or activated exclusively in a vehicle resting mode, wherein the input unit is adjusted to carry out changes of operating parameters in the modified profiles exclusively in a vehicle resting mode, and wherein the rules define relative operating states which are to be avoided by the rail vehicle during normal operation.

2. The apparatus of claim 1, wherein the selection unit is adjusted such that a saved profile is selected by the selection unit from a selection of available profiles.

3. The apparatus of claim 1, wherein the data processing unit is adjusted such that settings of an operating parameter of a system force an automatic influencing of an additional operating parameter of another system.

4. The apparatus of claim 1, wherein the data processing unit suggests a profile for further use as a function of operating conditions.

5. The apparatus of claim 1, wherein the apparatus comprises a transmitting unit for transferring profiles and/or operating parameters.

6. A method for configuring systems in a rail vehicle using an apparatus that includes a data processing unit, information-transmitting connections from the data processing unit to the systems, a selection unit for selecting a saved profile, an input unit for inputting operating parameters, and a reception unit for receiving additional or modified profiles, wherein the method comprises:

receiving, as necessary, additional or modified profiles via a reception unit;

selecting a profile by the selection unit the profile containing operating parameters and rules for controlling the systems in the rail vehicle, wherein in response to a detected operation of one of the operating parameters in one of the rail systems, another of the operating parameters is operated according to the selected profile;

modifying the operating parameters by the input unit as necessary;

generating control information by the data processing unit as a function of a profile; and transferring the generated control information to the systems in the rail vehicle, wherein additional and modified profiles are received or activated exclusively in a vehicle resting mode, wherein changes to operating parameters in the modified profiles are carried out exclusively in a vehicle resting mode, and wherein the rules define relative operating states which are to be avoided by the rail vehicle during normal operation.

7. The method of claim 6, wherein settings of an operating parameter of a system force an automatic influencing of an additional operating parameter of another system.

8. The method of claim 6, wherein the data processing unit suggests a profile as a function of operating conditions.

9. A computer-implemented method for controlling systems in a rail vehicle, the method comprising:

receiving a new or modified profile as necessary;

selecting a profile from a selection of available profiles containing operating parameters and rules for controlling the rail vehicle systems, wherein in response to a detected operation of one of the operating parameters in one of the rail systems, another of the operating parameters is operated according to the selected saved profile;

inputting operating parameters necessary changes are received;

generating control information as a function of a profile; and transferring the generated control information to other rail vehicle systems, wherein additional and modified profiles are received or activated exclusively in a vehicle resting mode, wherein changes to operating parameters in the modified profiles are carried out exclusively in a vehicle resting mode, and wherein the rules define relative operating states which are to be avoided by the rail vehicle during normal operation.

10. A non-transitory computer program product comprising commands which, when executed on a computer, cause the computer to execute a method comprising:

receiving a new or modified profile as necessary;

selecting a profile from a selection of available profiles containing operating parameters and rules for controlling the rail vehicle systems, wherein in response to a detected operation of one of the operating parameters in one of the rail systems, another of the operating parameters is operated according to the selected saved profile;

inputting operating parameters necessary changes are received;

generating control information as a function of a profile; and transferring the generated control information to other rail vehicle systems, wherein additional and modified profiles are received or activated exclusively in a vehicle resting mode, wherein changes to operating parameters in the modified profiles are carried out exclusively in a vehicle resting mode, wherein the rules define relative operating states which are to be avoided by the rail vehicle during normal operation.

* * * * *